US009364844B2

(12) United States Patent
Franchini et al.

(10) Patent No.: US 9,364,844 B2
(45) Date of Patent: Jun. 14, 2016

(54) DISPENSING HEAD WITH A NEW FLOW ADJUSTMENT UNIT FOR A POP-UP UNDERGROUND SPRINKLER

(71) Applicant: Claber S.p.A., Fiume Veneto (IT)

(72) Inventors: Gaetano Franchini, Fiume Veneto (IT); Renzo Corazza, Meduna di Livenza (IT)

(73) Assignee: CLABER S.P.A., Fiume Veneto (PN) (IT)

( * ) Notice: Subject to any disclaimer, the term of this patent is extended or adjusted under 35 U.S.C. 154(b) by 0 days.

(21) Appl. No.: 14/614,466

(22) Filed: Feb. 5, 2015

(65) Prior Publication Data

US 2015/0217321 A1 Aug. 6, 2015

(30) Foreign Application Priority Data

Feb. 5, 2014 (IT) ..... MI2014A0165

(51) Int. Cl.

| | |
|---|---|
| ***B05B 15/10*** | (2006.01) |
| ***B05B 3/02*** | (2006.01) |
| ***B05B 1/30*** | (2006.01) |
| *B05B 1/26* | (2006.01) |

(52) U.S. Cl.

CPC ..... *B05B 15/10* (2013.01); *B05B 1/3026* (2013.01); *B05B 3/02* (2013.01); *B05B 1/265* (2013.01)

(58) Field of Classification Search

CPC .... B05B 15/065; B05B 15/066; B05B 15/08; B05B 15/10; B05B 3/02; B05B 1/26; B05B 1/262; B05B 1/265; B05B 1/30; B05B 1/3026

USPC ..... 239/201–206

See application file for complete search history.

(56) References Cited

U.S. PATENT DOCUMENTS

| | | | |
|---|---|---|---|
| 3,088,677 | A | 5/1963 | Coffey et al. |
| 5,749,518 | A | 5/1998 | Wang |
| 2007/0210188 | A1 | 9/2007 | Schapper et al. |

FOREIGN PATENT DOCUMENTS

| | | | |
|---|---|---|---|
| EP | 1 043 075 AI | | 10/2000 |
| EP | 1 173 286 | A1 | 1/2002 |
| WO | 97/35668 | A1 | 10/1997 |

*Primary Examiner* — Christopher Kim

(74) *Attorney, Agent, or Firm* — Jacobson Holman, PLLC.

(57) ABSTRACT

An underground sprinkler of the pop-up type, comprising a main tubular outer body, intended to be vertically buried underground, and an inner body or moving piston slidably inserted into said main body, includes a water dispensing head provided with a diffusing unit at the top of said inner body or piston. The above-mentioned moving piston is typically elastically held in a resting position with its head lowered, and it is displaceable to the irrigation position with its head lifted by a pressure of the water supplied to the base of the main body. The dispensing head comprises a jet adjusting unit arranged in such a position as to be manually accessible from the outside when said head is lifted to the irrigation position.

4 Claims, 6 Drawing Sheets

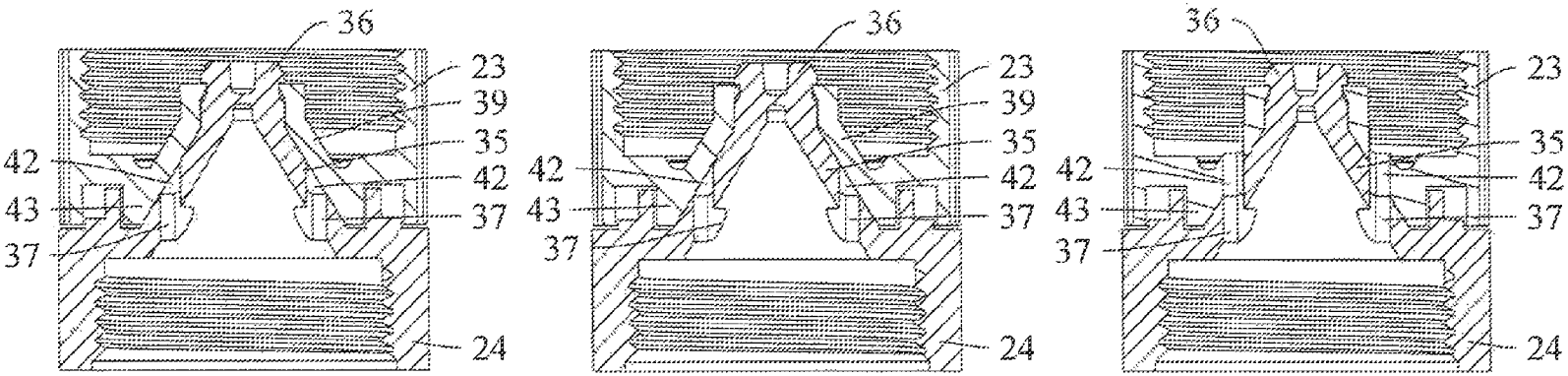
FIG.8
FIG.9
FIG.10
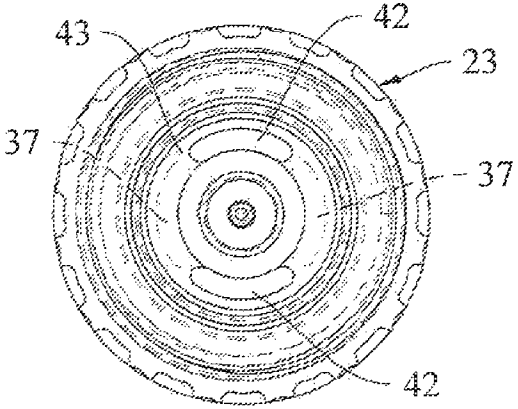
FIG.11
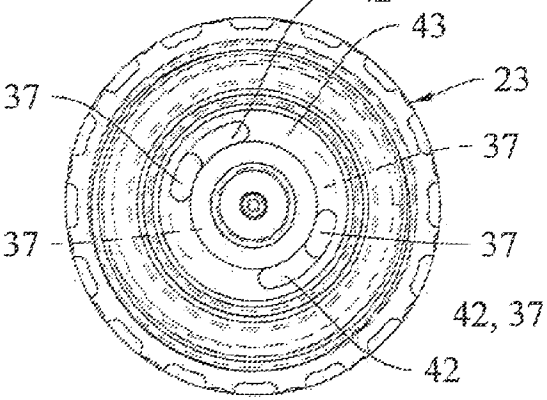
FIG.12
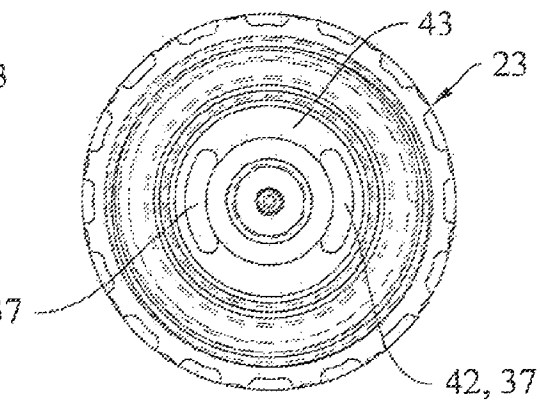
FIG.13

DISPENSING HEAD WITH A NEW FLOW ADJUSTMENT UNIT FOR A POP-UP UNDERGROUND SPRINKLER

The present invention relates to a dispensing head with new flow adjustment unit for pop-up underground sprinkler.

BACKGROUND OF THE INVENTION

Gardening irrigation systems are known, which comprise so-called "pop-up" water dispensing devices, consisting of a main tubular outer body, vertically buried underground, and of an inner body or moving piston slidably inserted into said main body and ending with a water dispensing head provided with a diffusing unit. The piston is typically elastically held in a resting position with its head lowered, and it is displaceable to an irrigation position with head lifted by the pressure of the water supplied at the base of the main body by a suitable water supply system.

Dispensing devices for such underground irrigation systems are described, for example, in patents EP 1 043 075 A1 and EP 1 173 286 B1.

In order to allow the dispensed water jet to be adjusted, an adjusting screw is usually included between the dispensing head and the moving piston, which can be accessed only once the terminal ferrule of the main body has been disassembled and the head has been separated from the piston. An Allen wrench inserted into an underlying cavity of the adjusting screw is used to change the position of the screw, thereby adjusting the flow rate of the water dispensed.

This operation is clearly quite complex and often requires the intervention of skilled personnel.

U.S. Pat. No. 3,088,677 A describes a dispensing head for a pop-up underground sprinkler comprising a jet adjusting unit which can be externally accessed when the head is lifted to the irrigation position.

In light of this prior art, it is the object of the present invention to provide a dispensing head for pop-up underground sprinkler which has a new flow adjusting system which is easy to be accessed and operated.

BRIEF SUMMARY OF THE INVENTION

The object of the invention is achieved by a dispensing head for pop-up underground sprinkler as defined in claim 1.

The adjusting unit substantially comprises a rotary annular body located in an intermediate position between an upper body supporting the diffusing unit, and a lower body secured to the head moving piston, said rotary intermediate body being provided with water-passing loops which, by changing the angular position of the intermediate body, are able to partially or completely close or open corresponding through loops of the lower body communicating with the base of said main body. A suitably shaped insert is inserted into the above-mentioned upper body in order to allow water to pass therethrough.

The user of the irrigation system can adjust the jet flow rate by operating with easy accessibility and operation and without needing to resort to any tools.

BRIEF DESCRIPTION OF THE SEVERAL VIEWS OF THE DRAWINGS(S)

The features of the present invention will become more apparent from the following detailed description of an embodiment thereof, given by way of illustrative, non-limiting example in the accompanying drawings, in which:

FIGS. 8-10 are axial sectional views of a part of said adjusting unit in the closed, partially open, and completely open flow positions, respectively;

FIGS. 11-13 are top plane views of the same part of said adjusting unit, in the closed, partially open, and completely open flow positions, respectively.

DETAILED DESCRIPTION OF THE INVENTION

Figure 1:
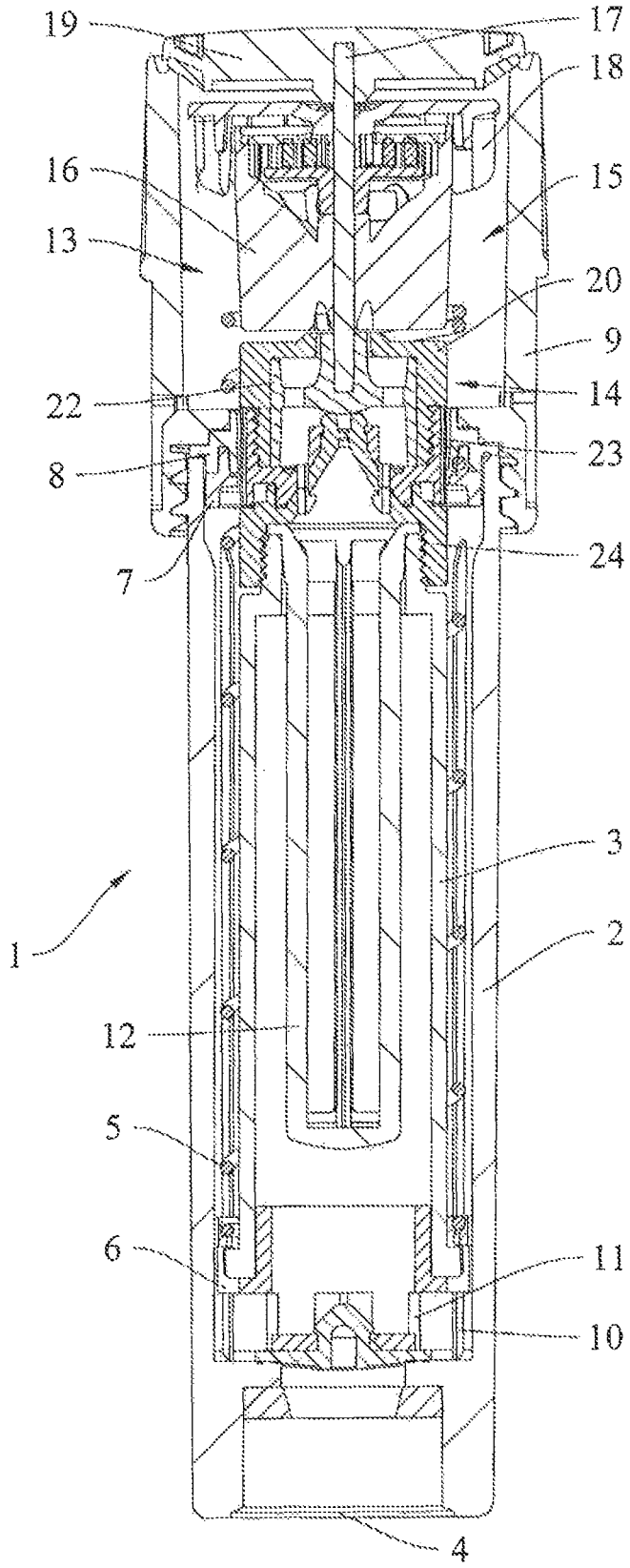
FIG. 1 shows in an axial section a pop-up sprinkler with a dispensing head according to the present invention in a lowered resting position.
Figure 2:
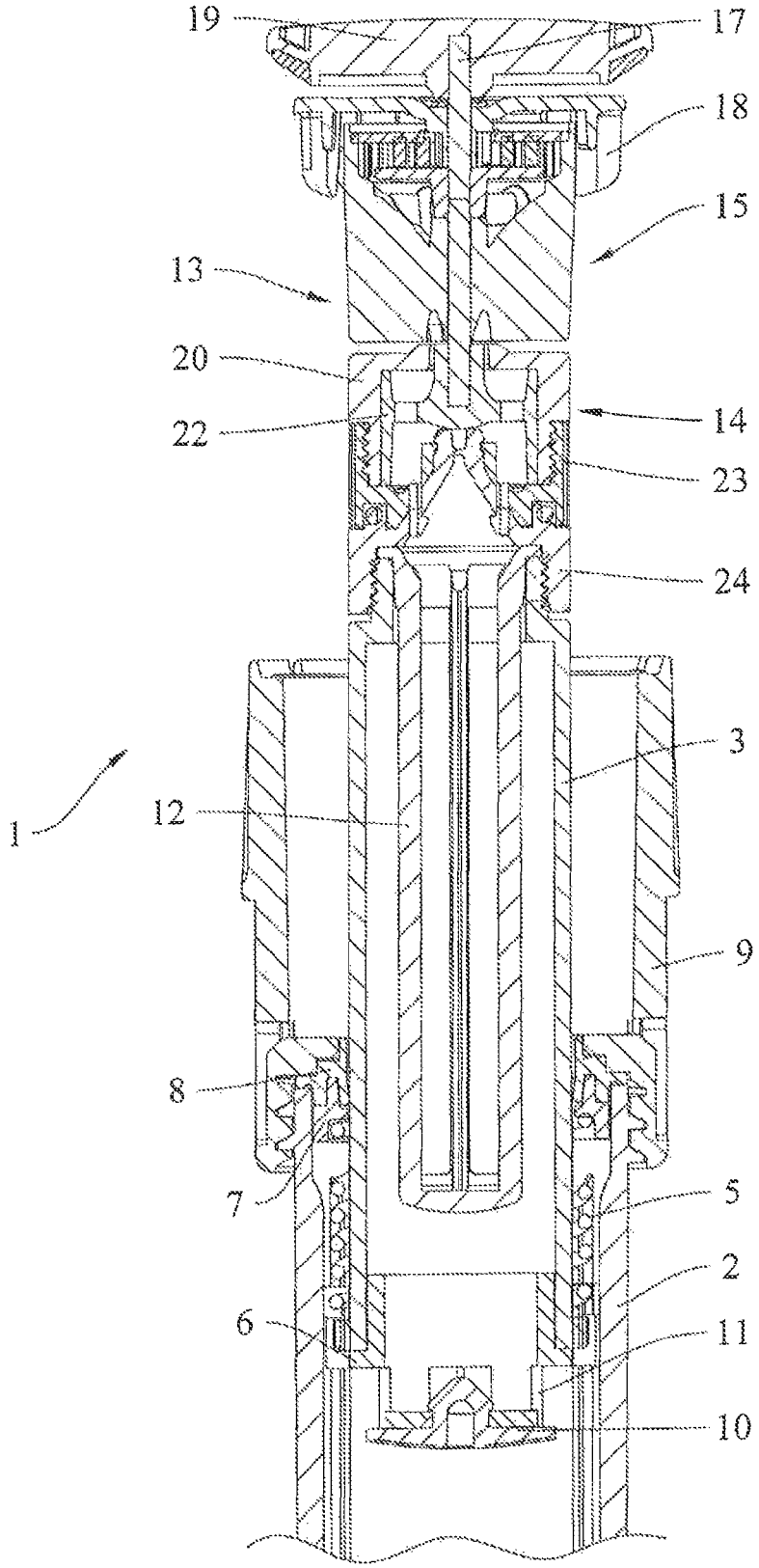
FIG. 2 shows an axial section of the same sprinkler with its head in the jet-dispensing lifted position.

In FIGS. 1 and 2, an underground sprinkler 1 of the pop-up type is shown in the resting position and in the jet dispensing position, respectively, comprising an outer tubular body or main body 2 intended to be vertically inserted into the soil of the lawn, garden, or the like, for which the irrigation is required, and an inner body or piston 3 slidably inserted into said main body 2 so as to be lifted from the resting position in FIG. 1 to the jet dispensing position in FIG. 2. The lifting of piston 3 is determined by the pressure of the water supplied, when desired, to the lower mouth 4 of the main body 2 from a suitable water supply system (of any known type). Instead, the descent of piston 3 to be returned into the main body 2 is determined, in the absence of water pressure, by a spring 5 arranged about piston 3 and acting between an outer lower edge 6 and a double upper ring 7, 8 hold in place by a ferrule 9 screwed at the top of the main body 2. The lower end of piston 3 is provided with a closing ring 10 with side windows 11, performing the double task of exploiting the water pressure to lift piston 3 and allowing, when the irrigation is completed, the water left inside piston 3 to outflow. A tubular filter 12 is located inside piston 3, serving to filter the water from the underground water supply system.

A dispensing head 13 is secured at the top of piston 3, acting to dispense the water required to irrigate the surface of the surrounding soil in the shape of a circular jet.

The dispensing head 13 has a lower part 14 forming a jet flow rate adjusting unit, and an upper part 15 forming the jet diffusing unit, here comprising a diffuser cylinder 16 freely rotatable abut a stationary pin 17, a counter-rotating fan 18 with respect to the diffuser cylinder 16 by virtue of a gearing, not shown in the drawings, and a cover member 19 secured at the top of pin 17.

The details of the diffuser cylinder 16, the fan 18, and the above-mentioned gearing are not set forth herein, since they are completely similar to those of the corresponding components described in patent EP 1 173 286 B1 by the same Applicant, which is expressly referred to for a complete description of such components, and which is meant to be incorporated in the present patent specification.

However, the present invention related to the position and structure of the jet flow rate adjusting unit is not to be meant as limited to the use with the jet diffusing unit shown in the drawings and described in EP 1 173 286 B1. Indeed, the present invention is applicable to any jet dispensing head irrespective of the diffusion unit which is used.

The lower part 14 of the dispensing head 13 forming, as stated, the jet flow rate adjusting unit, is located with respect to the piston in a position so as to exit the footprint of the main body 2 during irrigation, thus being manually accessible from outside, as shown in FIG. 2.

Figure 3:
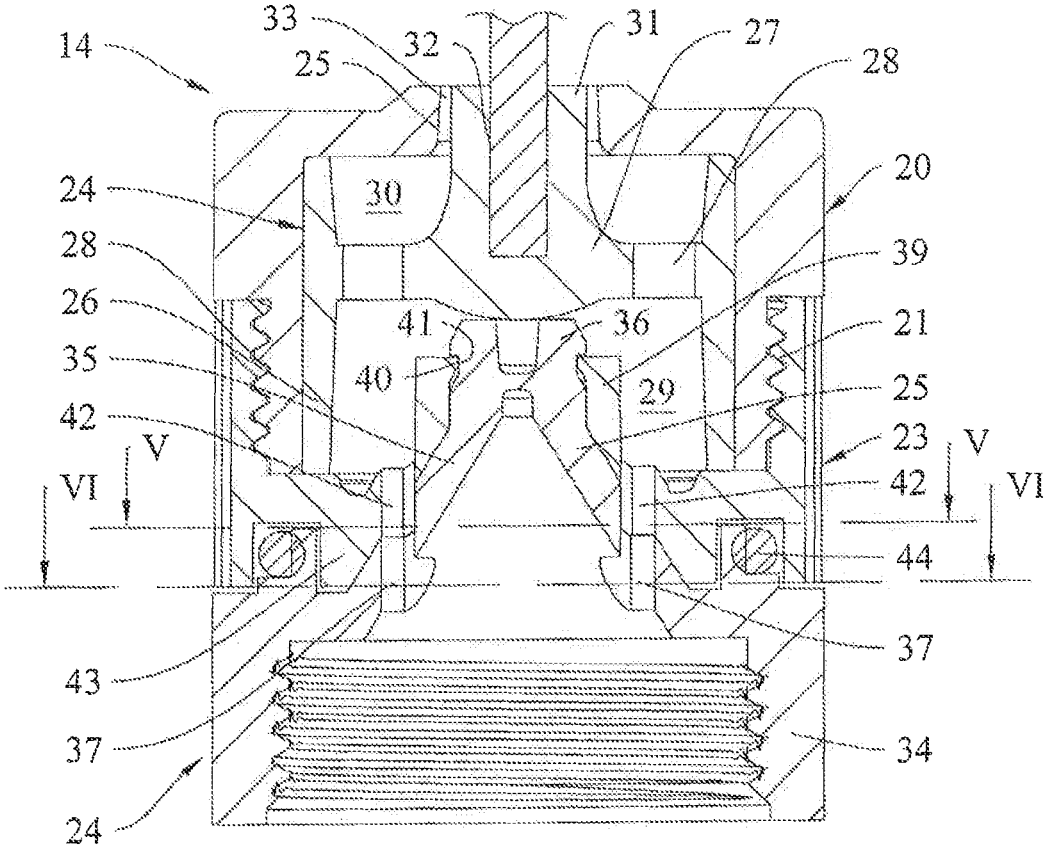
FIG. 3 shows an axial section of the enlarged detail of the jet adjusting unit inserted into the dispensing head of the sprinkler in the previous figures.
Figure 4:
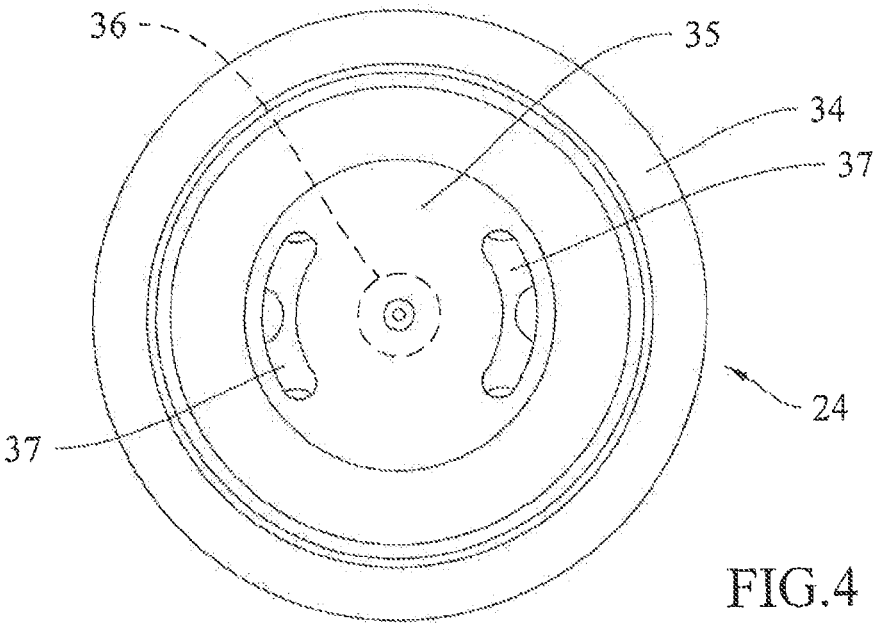
FIG. 4 shows said adjusting unit as seen from the bottom compared to FIG. 3.
Figure 5:
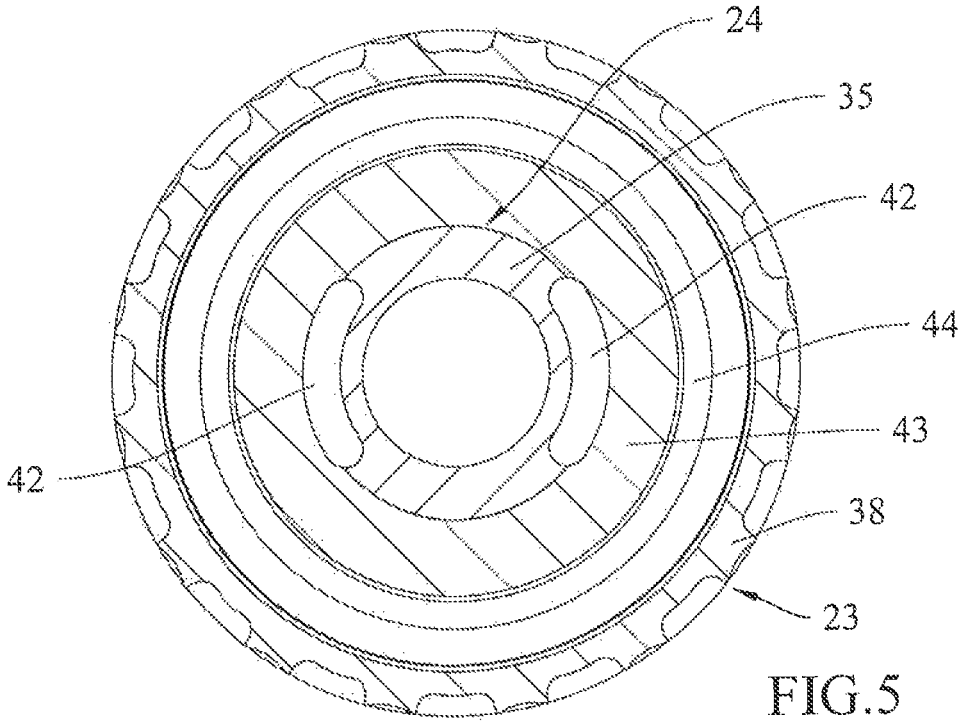
FIG. 5 shows said adjusting unit in a cross-section taken along the line V-V in FIG. 4.
Figure 6:
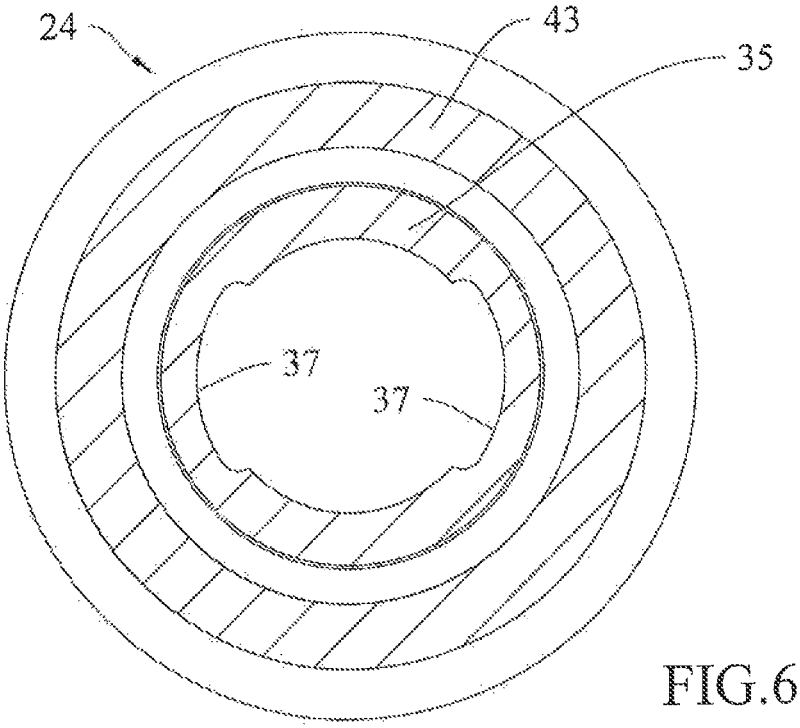
FIG. 6 shows said adjusting unit in a cross-section taken along the line VI-VI in FIG. 4.

The adjusting unit 14 is shown in an enlarged scale in FIG. 3 and comprises an upper body 20 secured to pin 17 and provided with a threaded lower part 21, an insert 22 snap-fitted into the upper body 20, an intermediate body 23 screwed onto the threaded part 21 of the upper body 20, and a lower body 24 screwed on the upper end of the piston 3.

Figure 7:
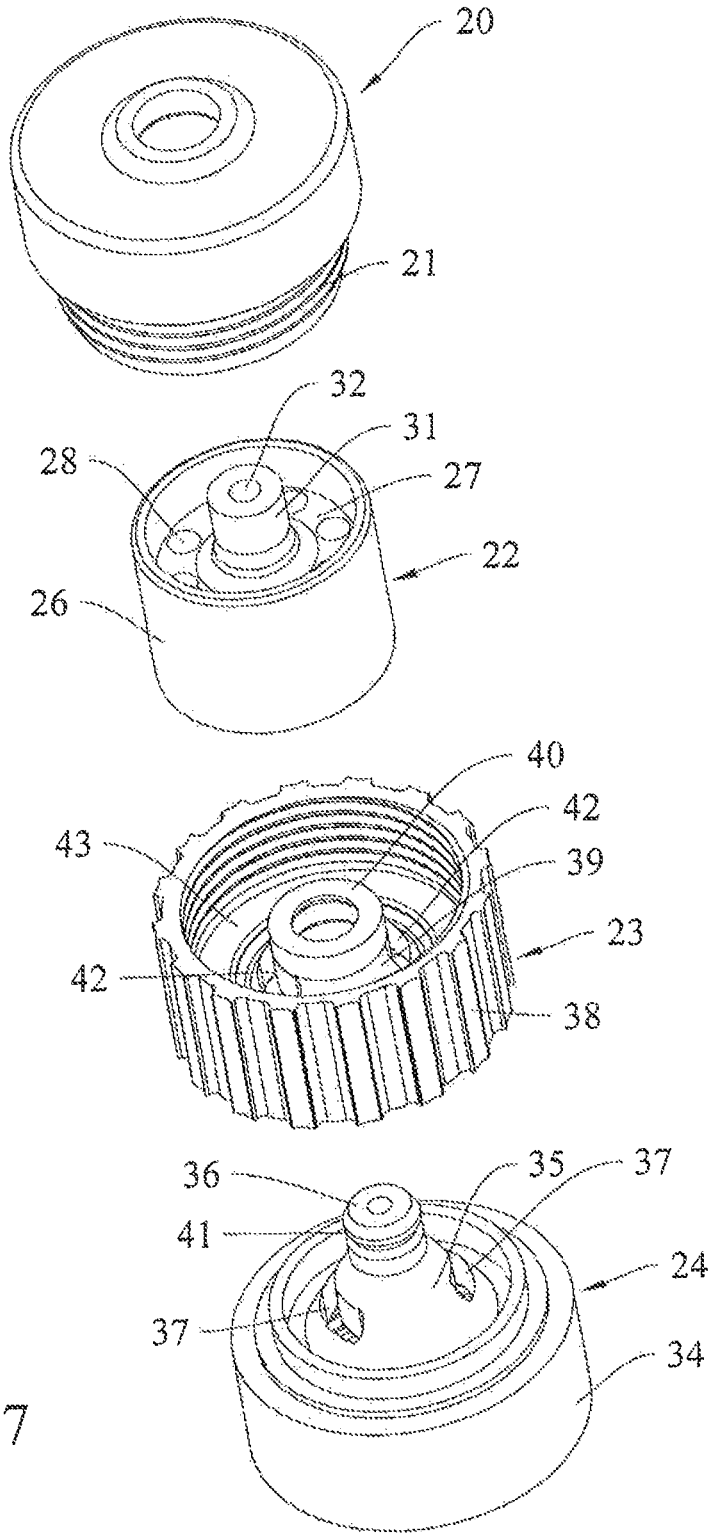
FIG. 7 shows the components of said adjusting unit in an exploded perspective view.

As further shown in FIG. 7, the upper body 20 is substantially overturned cup-shaped and has an axial hole 25 at the top.

As shown in the FIGS. 3 and 7, insert 22 in turn includes an annular peripheral wall 26 and a circular intermediate cross-bar 27 crossed by axial holes 28 which are arranged circumferentially, dividing the inner space of insert 22 into a lower cavity 29 and an upper cavity 30. Above the cross-bar 27, insert 22 has an annular neck 31 with a central blind hole 32. Neck 31 is inserted into the hole 25 of the upper body 20 where, since it has a smaller diameter, it creates an annular slit 33. The lower end of pin 17 is forcedly pressed into the central blind hole 32.

As shown in FIGS. 3-7, the lower body 24 has an annular peripheral wall 34, internally threaded, from which a truncated cone, funnel-shaped central part 35 extends upward, ending in a closed neck 36. The truncated cone-shaped part 35 is crossed by two diametrically opposite elongated loops 37.

Finally, the intermediate body 23 has an annular peripheral wall 38 with vertical outer grooves, a base 43, and a central part 39 surrounding the truncated cone-shaped part 35 of the lower body 24 and grabs thereon by inserting an annular projection 40 thereof into an annular valley 41 of said truncated cone-shaped part 35. The above-mentioned central part 39 is crossed by diametrically opposite loops 42, completely similar to the loops 37 of the lower body 24 and similarly arranged so as to overlap or not the loops 37 according to the angular position of the intermediate body 23. An O-ring 44 is interposed between the base 43 of the intermediate body 23 and the top of the wall 34 of the lower body 24 (FIG. 3).

Three possible angular positions of the intermediate body 23 with respect to the lower body 24, and hence of the loops 42 with respect to the loops 37, are shown in FIGS. 8-13. A different jet dispensing condition by the dispensing head 13 corresponds to each of them.

With the intermediate body rotated to the position of FIGS. 8 and 11, loops 42 do not match with the underlying loops 37, resulting in an obstruction for the water to pass and also in the consequent failed dispensing of the jet.

By rotating the intermediate body 23 to the position of FIGS. 9 and 12 (about 45°), the upper loops 42 partially match with the lower loops 37, so as to allow a limited water flow to pass, which through the lower cavity 29, the holes 28, and the upper cavity 30 of insert 22, and the slit 33, reaches the diffuser cylinder 16 which, through the inner passageways thereof, dispenses a coil-shaped flow radially directed by fan 19, as explained in EP 1 173 286 B.

By further rotating the intermediate body 23 until reaching an angular position of 90° with respect to the completely closed position in FIGS. 8 and 11, the loops 42 of the intermediate body 23 fully overlap the loops 36 of the lower body 24 (FIGS. 10 and 13), thus causing the maximum opening of the water path, hence the maximum irrigation jet flow rate.

The described adjustment of the jet can be performed manually, with the dispensing head 13 in the lifted position in FIG. 2.

The invention claimed is:

1. A dispensing device for an underground sprinkler comprising a main tubular outer body, intended to be vertically buried underground, and an inner piston slidably inserted into said main tubular outer body and the inner piston being in connection with a water dispensing head provided with a diffusing unit, said piston being elastically held in a resting position with the water dispensing head lowered and displaceable to an irrigation position with the water dispensing head lifted by a pressure of the water supplied to a base of the main tubular outer body, said water dispensing head comprising a jet adjusting unit arranged in a position so as to be manually accessible from outside of the water dispensing head when said water dispensing head is lifted to the irrigation position, and said jet adjusting unit comprising a rotary annular intermediate body arranged in an intermediate position between an upper body supporting the diffusing unit and a lower body secured to the piston for moving the water dispensing head, said rotary annular intermediate body being provided with water-passing loops which, by changing an angular position of the rotary annular intermediate body, overlaps with or does not overlap with corresponding loops of the lower body to partially or completely open or close the passage of water from the base of said main tubular outer body to the diffusing unit, an insert being snap-fitted in said upper body, the insert having an annular peripheral wall and a circular intermediate cross-bar crossed by axial holes arranged circumferentially, the circular intermediate cross-bar dividing an inner space of the insert into a lower cavity and an upper cavity, said insert ending at a top in an annular neck with a central blind hole, which is inserted into an axial upper hole of said upper body so as to define an annular slit surrounding the annular neck.

2. The dispensing device according to claim 1, wherein said lower body has an annular peripheral wall which can be screwed onto a top of the piston and a truncated cone-shaped central part extending upwardly to a closed neck, said truncated cone-shaped part being crossed by two diametrically opposite, elongated loops.

3. The dispensing device according to claim 2, wherein said rotary annular intermediate body has an annular peripheral wall with vertical outer grooves, a base, and a central part surrounding and grasping the truncated cone-shaped part of the lower body, said central part being crossed by diametrically opposite loops corresponding to the loops of the lower body and placed so as to overlap or not the loops according to the angular position of the rotary annular intermediate body.

4. The dispensing device according to claim 3, wherein an O-ring is interposed between the base of the rotary annular intermediate body and the top of the peripheral wall of the lower body.

* * * * *